US007892007B2

(12) United States Patent
Scherer et al.

(10) Patent No.: US 7,892,007 B2
(45) Date of Patent: Feb. 22, 2011

(54) ELECTRICAL CONNECTOR ASSEMBLY

(75) Inventors: Richard J. Scherer, Austin, TX (US); Joseph N. Castiglione, Cedar Park, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 12/192,265

(22) Filed: Aug. 15, 2008

(65) Prior Publication Data

US 2010/0041273 A1 Feb. 18, 2010

(51) Int. Cl.
*H01R 13/62* (2006.01)

(52) U.S. Cl. ..... 439/329; 439/357; 439/607.4

(58) Field of Classification Search ..... 439/607, 439/159, 152, 160, 329, 357, 607.35–607.4
See application file for complete search history.

(56) References Cited

U.S. PATENT DOCUMENTS

| | | | | |
|---|---|---|---|---|
| 5,766,027 | A | 6/1998 | Fogg | |
| 6,368,120 | B1 | 4/2002 | Scherer et al. | |
| 6,431,887 | B1 | 8/2002 | Yeomans et al. | |
| 6,508,678 | B1 * | 1/2003 | Yang | 439/677 |
| 6,517,382 | B2 | 2/2003 | Flickinger et al. | |
| 6,524,134 | B2 | 2/2003 | Flickinger et al. | |
| 6,655,995 | B1 | 12/2003 | Reisinger et al. | |
| 6,666,720 | B1 | 12/2003 | Reisinger et al. | |
| 6,682,368 | B2 | 1/2004 | Murr et al. | |
| 6,752,663 | B2 * | 6/2004 | Bright et al. | 439/607 |
| 6,805,573 | B2 | 10/2004 | Phillips et al. | |
| 6,943,287 | B2 | 9/2005 | Lloyd et al. | |
| 7,004,793 | B2 | 2/2006 | Scherer et al. | |
| 7,226,314 | B2 * | 6/2007 | Lang et al. | 439/607 |
| 7,281,938 | B1 | 10/2007 | Wu | |
| 2003/0104725 | A1 | 6/2003 | Kerlin et al. | |
| 2004/0097136 | A1 | 5/2004 | Flickinger et al. | |
| 2007/0212940 | A1 * | 9/2007 | Ker et al. | 439/607 |
| 2007/0223208 | A1 * | 9/2007 | Tanaka et al. | 361/807 |
| 2007/0293063 | A1 * | 12/2007 | Droesbeke et al. | 439/108 |

OTHER PUBLICATIONS

Test: *Joy Signal Technology*, "Joy Diffcon Connector," Test 518, MERITEC®, Sep. 14, 2006, 6 pages.
Product Information: *Joy Signal Technology*, "Differential Terminations," MERITEC®, May 4, 2007.
U.S. Appl. No. 11/777,511; Richard J. Scherer, Adam P. Rumsey, Joseph N. Castiglione; Jul. 13, 2007.

* cited by examiner

*Primary Examiner*—Neil Abrams
*Assistant Examiner*—Phuongchi T Nguyen
(74) *Attorney, Agent, or Firm*—Johannes P. M. Kusters

(57) ABSTRACT

An electrical connector assembly includes a printed circuit board, a header coupled to the printed circuit board, and an electrical cable termination configured to mate with the header. The printed circuit board has a printed circuit board ground contact. The header includes an insulative housing and a plurality of contact pins disposed in the insulative housing. The header and electrical cable termination are configured such that the electrical cable termination makes electrical contact with at least one of the contact pins and the printed circuit board ground contact when the header and electrical cable termination are in a mated configuration. The electrical connector assembly may include a conductive shield at least partially enclosing the header and electrical cable termination.

19 Claims, 7 Drawing Sheets

ELECTRICAL CONNECTOR ASSEMBLY

TECHNICAL FIELD

The present invention relates to a high speed electrical connector assembly to provide interconnections between a printed circuit board and one or more electrical cables. More particularly, the present invention relates to a shielding device that can be included in the electrical connector assembly to provide adequate protection from electromagnetic interference (EMI) emissions.

BACKGROUND

Interconnection of integrated circuits to other circuit boards, cables or electronic devices is known in the art. Such interconnections typically have not been difficult to form, especially when the circuit switching speeds (also referred to as edge rates or signal rise times) have been slow when compared to the length of time required for a signal to propagate through a conductor in the interconnect or in the printed circuit board. As user requirements grow more demanding with respect to circuit switching speeds, the design and manufacture of interconnects that can perform satisfactorily in terms of electrical performance has grown more difficult.

In addition, the use of faster switching speeds can be restricted by electromagnetic interference (EMI). EMI is a disturbance caused by electromagnetic radiation emitted from an external source. The disturbance may interrupt, obstruct, or otherwise degrade or limit the effective performance of an electrical circuit. The source may be any object, artificial or natural, that carries rapidly changing electrical currents.

Connectors have been developed to provide the necessary impedance control for high speed circuits, i.e., circuits with a transmission frequency of at least 5 GHz. Although many of these connectors are useful, there is still a need in the art for connector designs having closely controlled electrical characteristics as well as adequate protection from electromagnetic interference (EMI) emissions to achieve satisfactory control of the signal integrity.

SUMMARY

In one aspect, the present invention provides an electrical connector assembly including a printed circuit board, a header coupled to the printed circuit board, and an electrical cable termination configured to mate with the header. The printed circuit board has a printed circuit board ground contact. The header includes an insulative housing and a plurality of contact pins disposed in the insulative housing. The header and electrical cable termination are configured such that the electrical cable termination makes electrical contact with at least one of the contact pins and the printed circuit board ground contact when the header and electrical cable termination are in a mated configuration.

In another aspect, the present invention provides an electrical connector assembly including a printed circuit board, a header coupled to the printed circuit board, an electrical cable termination configured to mate with the header, and a conductive shield at least partially enclosing the header and electrical cable termination. The printed circuit board has a printed circuit board ground contact. The header includes an insulative housing and a plurality of contact pins disposed in the insulative housing. The header and electrical cable termination are configured such that the electrical cable termination makes electrical contact with at least one of the contact pins and the printed circuit board ground contact when the header and electrical cable termination are in a mated configuration.

In another aspect, the present invention provides an electrical connector assembly including a printed circuit board, a header coupled to the printed circuit board, an electrical cable assembly configured to mate with the header, and a conductive shield at least partially enclosing the header and electrical cable assembly. The printed circuit board has a printed circuit board ground contact and a printed circuit board ground element. The conductive shield is coupled to the printed circuit board ground element. The header includes an insulative housing and a plurality of contact pins disposed in the insulative housing. The electrical cable assembly includes an electrical cable termination and an electrical cable including one or more conductors and a ground shield surrounding the one or more conductors. The header, electrical cable assembly, and conductive shield are configured such that the electrical cable termination makes electrical contact with at least one of the contact pins and the printed circuit board ground contact, and the conductive shield makes electrical contact with at least one of the electrical cable termination and the ground shield when the header and electrical cable assembly are in a mated configuration.

The above summary of the present invention is not intended to describe each disclosed embodiment or every implementation of the present invention. The Figures and detailed description that follow below more particularly exemplify illustrative embodiments.

DETAILED DESCRIPTION

In the following detailed description of the preferred embodiments, reference is made to the accompanying drawings that form a part hereof. The accompanying drawings show, by way of illustration, specific embodiments in which the invention may be practiced. It is to be understood that other embodiments may be utilized, and structural or logical changes may be made without departing from the scope of the present invention. The following detailed description, therefore, is not to be taken in a limiting sense, and the scope of the invention is defined by the appended claims.

For purpose of clarity, aspects of the invention are described and illustrated herein as used with twinaxial cables and twinaxial cable terminations. However, such illustration is exemplary only, and it is understood and intended that other types of electrical cables and their associated electrical cable terminations can be used, including but not limited to coaxial cables and other cable configurations with signal and ground elements.

Figure 1:
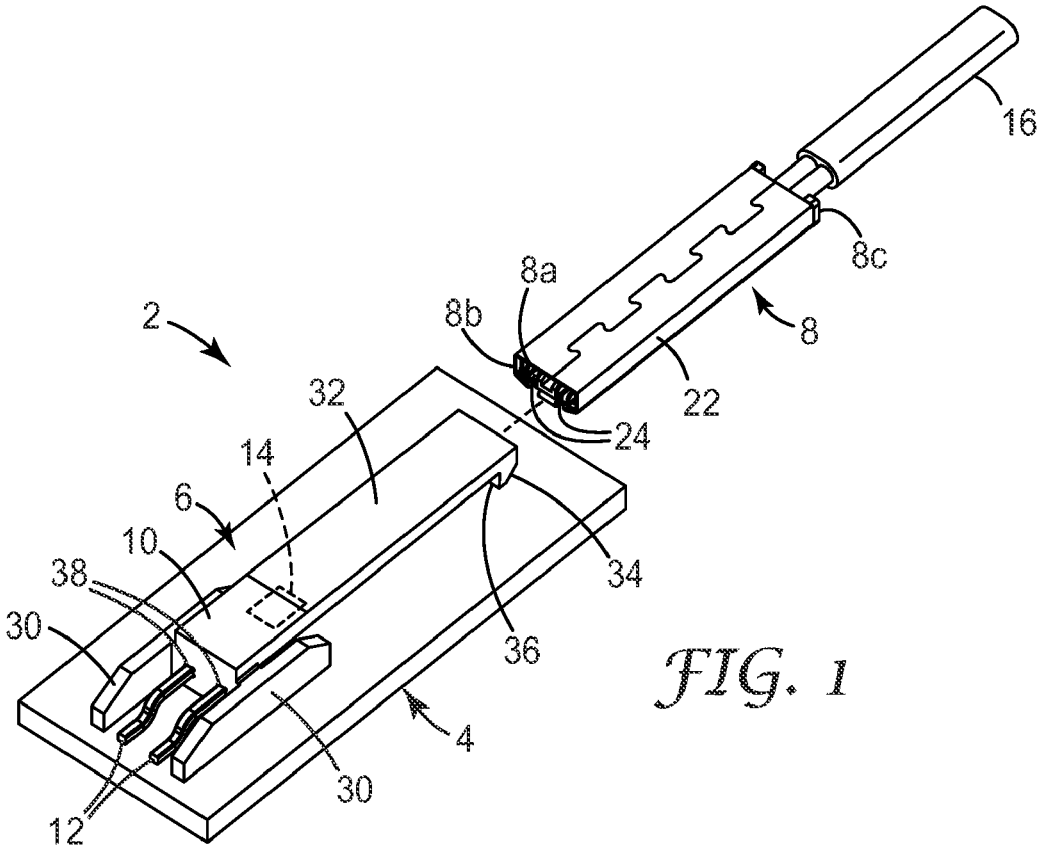
FIG. 1 is a top perspective view of an exemplary embodiment of an electrical connector assembly according to an aspect of the present invention showing the header and the electrical cable termination in an unmated configuration.
Figure 2:
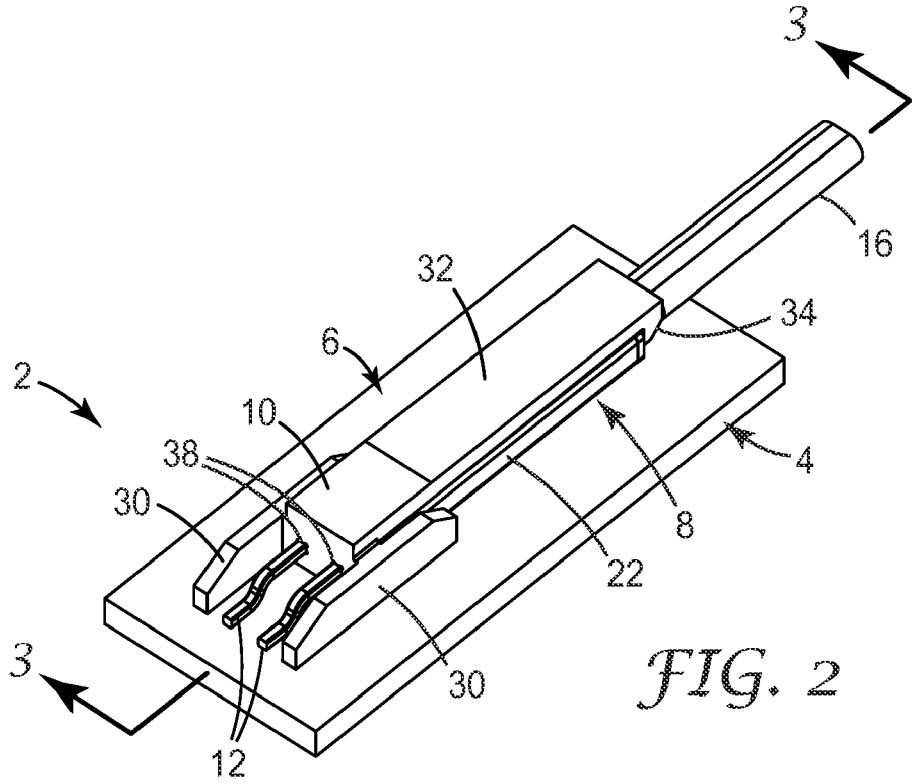
FIG. 2 is a top perspective view of the electrical connector assembly of FIG. 1 showing the header and the electrical cable termination in a mated configuration.
Figure 3:
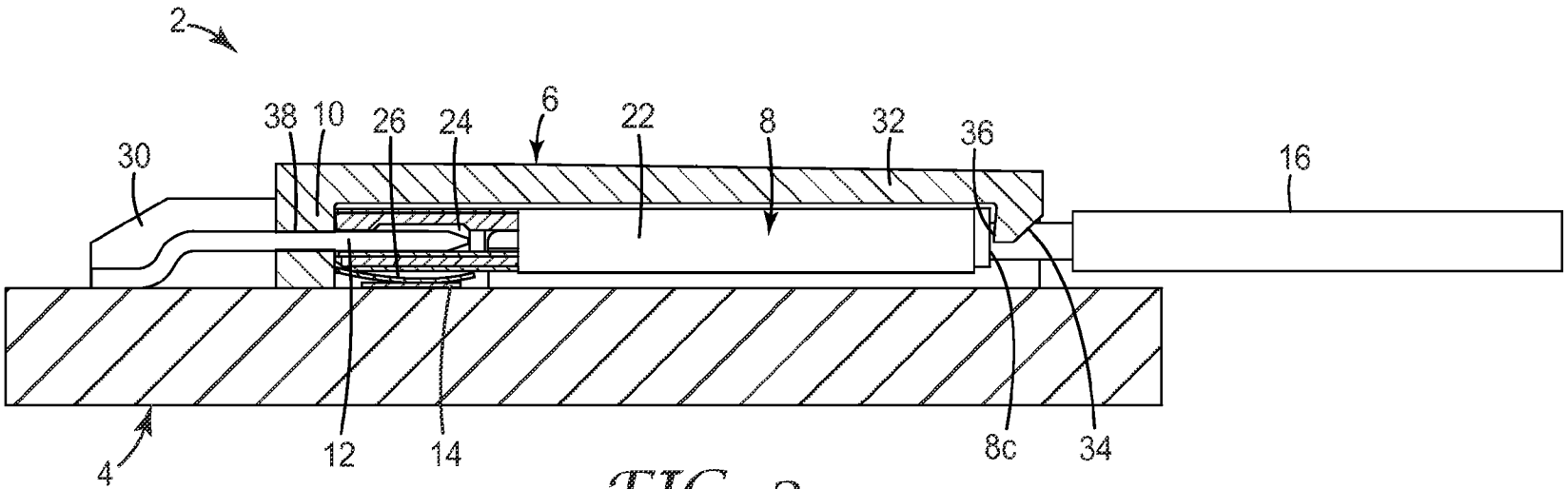
FIG. 3 is a cross-sectional view of the electrical connector assembly of FIG. 1 taken along line 3-3 of FIG. 2.
Figure 4:
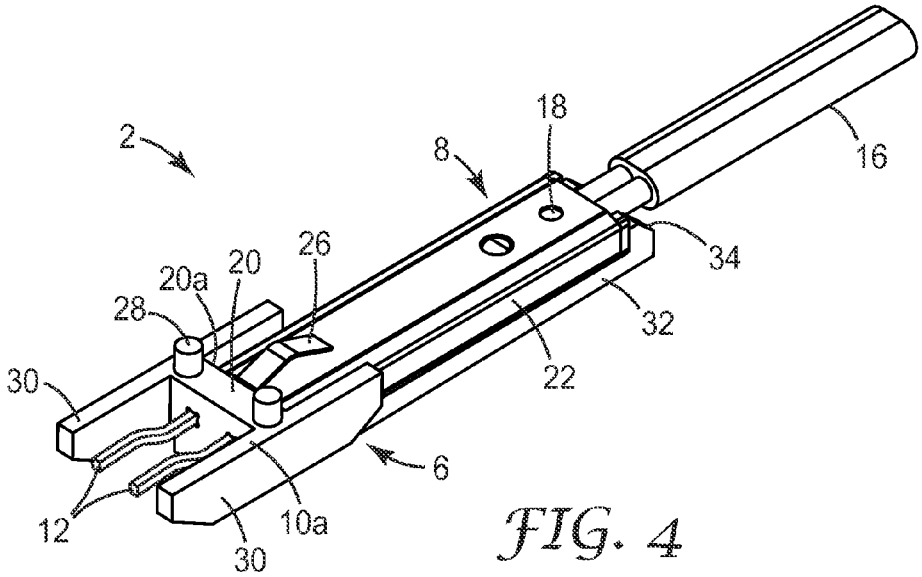
FIG. 4 is a bottom perspective view of the electrical connector assembly of FIG. 1 not showing the printed circuit board.

FIGS. 1-4 illustrate an exemplary embodiment of an electrical connector assembly according to an aspect of the present invention. Electrical connector assembly 2 includes a printed circuit board 4, a header 6 coupled to printed circuit board 4, and an electrical cable termination 8 configured to mate with header 6. Header 6 includes an insulative housing 10 and a plurality of contact pins 12 disposed in insulative housing 10. Printed circuit board 4 includes a printed circuit board ground contact 14. When header 6 and electrical cable termination 8 are in a mated configuration, electrical cable termination 8 makes electrical contact with contact pins 12 and printed circuit board ground contact 14, as best shown in FIG. 3. In alternative embodiments, electrical cable termination 8 may make electrical contact with at least one of contact pins 12 and printed circuit board ground contact 14.

Electrical cable terminations that can be used in conjunction with header 6 and printed circuit board 4 can be constructed substantially similar to the shielded controlled impedance (SCI) connectors for a coaxial cable described in U.S. Pat. No. 5,184,965, incorporated by reference herein. In particular, an exemplary embodiment of an electrical cable termination that can be used in conjunction with header 6 and printed circuit board 4 is electrical cable termination 8. Electrical cable termination 8 is coupled to header 6 such that front face 8*a* of electrical cable termination 8 abuts front surface 20*a* of interior wall 20 of insulative housing 10. Electrical cable termination 8 is coupled to an electrical cable 16 through the use of solder opening 18. Electrical cable 16 can be a single wire cable (e.g. single coaxial or single twinaxial) or a multiple wire cable (e.g. multiple coaxial, multiple twinaxial, or twisted pair). In one embodiment, electrical cable 16 includes one or more conductors and a ground shield surrounding the one or more conductors. In the embodiment of FIGS. 1-4, electrical cable 16 includes two conductors and a ground shield surrounding the two conductors.

Electrical cable termination 8 includes an electrically conductive housing 22 having mounted therein internal contacts 24. Internal contacts 24 are configured to make electrical contact with contact pins 12 of header 6 and lie along the longitudinal axis of electrical cable termination 8. Each internal contact 24 can be designated as a signal/power contact, in which case it is electrically connected to a signal/power conductor of electrical cable 16 and electrically insulated from conductive housing 22. Each internal contact 24 can be designated as a ground contact, in which case it is electrically connected to a ground conductor/shield of electrical cable 16 and/or to conductive housing 22.

Electrical cable termination 8 further includes an external electrical cable termination ground contact 26. External electrical cable termination ground contact 26 extends from an external surface of conductive housing 22 and is configured to make electrical contact with ground contact 14 of printed circuit board 4 when header 6 and electrical cable termination 8 are in a mated configuration, as best shown in FIG. 3. In the exemplary embodiment of an electrical connector assembly shown in FIGS. 1-4, printed circuit board ground contact 14 includes a single ground pad. In other embodiments, printed circuit board ground contact 14 may include one or more ground pins, an electrically conductive strip, or a plurality of ground pads, as is suitable for the intended application. In the illustrated embodiments, external electrical cable termination ground contact 26 includes a resilient beam extending from conductive housing 22. In other embodiments, external electrical cable termination ground contact 26 can take alternate forms from those illustrated, and may include, for example, a Hertzian bump extending from conductive housing 22.

Still referring to FIGS. 1-4, header 6 includes an insulative housing 10 and a plurality of contact pins 12 disposed in insulative housing 10 and arranged for mating with internal contacts 24 of electrical cable termination 8. Contact pins 12 of header 6 are connected to printed circuit board 4 as is known in the art. Contact pins 12 are configured for electrical connection to one or more of a plurality of electrical traces (not shown) of printed circuit board 4. Although header 6 is shown and described herein as a surface-mount pin header, header 6 may also be a through-hole pin header or any other suitable type of header known in the art. Contact pins 12 may be connected to printed circuit board 4 by soldering, press-fit, or other suitable approach. In the embodiment of FIGS. 1-4, header 6 is secured to printed circuit board 4 by the connection between contact pins 12 and printed circuit board 4 as well as mounting posts 28 extending from insulative housing 10. Mounting posts 28 are configured for insertion into holes in printed circuit board 4 (not shown). Mounting posts 28 may be retained in the holes in printed circuit board 4 by press-fit, adhesive, or other suitable approach. Alternatively, header 6 may include additional structure(s) for securing header 6 to printed circuit board 4, or may be secured to printed circuit board 4 only by the connection between contact pins 12 and printed circuit board 4.

Insulative housing 10 of header 6 includes two side walls 30, an interior wall 20 positioned between side walls 30, a resilient latch 32 extending from interior wall 20, and mounting posts 28 extending from a bottom surface 10*a* of insulative housing 10. Insulative housing 10 is monolithic, but may alternatively be formed as multiple individual elements (e.g., side walls 30, interior wall 20, latch 32, and mounting posts 28) assembled by any suitable method/structure, including but not limited to snap fit, friction fit, press fit, mechanical clamping, and adhesive. Insulative housing 10 is configured to receive and position electrical cable termination 8, which is retained in a mated configuration by latch 32. As electrical cable termination 8 is inserted into header 6, a front edge 8*b* of electrical cable termination 8 engages a latch lead-in surface 34 and deflects latch 32 out of the path of electrical cable termination 8. As electrical cable termination 8 is fully inserted, latch 32 returns to its original (undeflected) position, and a latch hook member 36 engages a back edge 8*c* of electrical cable termination 8, thereby preventing electrical cable termination from being pulled out of header 6. Electrical cable termination 8 can be removed from header 6 by simply deflecting latch 32 (as with a small tool or fingernail) to disengage latch hook member 36 from back edge 8*c* of electrical cable termination 8 while pulling gently on electrical cable 16. In other embodiments, electrical cable termination 8 may be retained within header 6 by any suitable method/structure, including but not limited to snap fit, friction fit, press fit, mechanical clamping, and adhesive. Interior wall 20 of insulative housing 10 includes a plurality of pin insertion apertures 38 configured to position and retain contact pins 12. Contact pins 12 may be retained in insertion apertures 38 by press-fit, friction fit, adhesive, or other suitable approach. Side walls 30 are configured to assist in aligning internal contacts 24 of electrical cable termination 8 and contact pins 12 during insertion of electrical cable termination 8 into header 6. Additionally, side walls 30 assist in providing stability to header 6 and protect contact pins 12 from being damaged.

Figure 5:
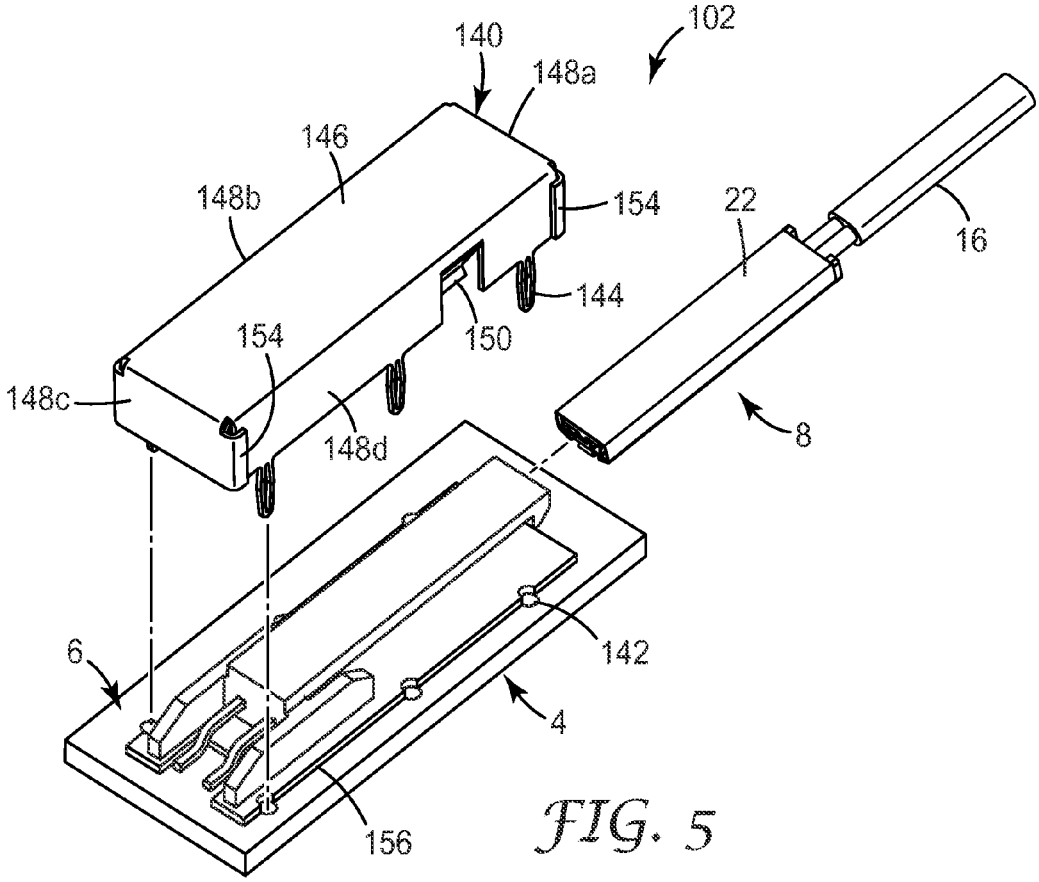
FIG. 5 is a top perspective view of another exemplary embodiment of an electrical connector assembly according to an aspect of the present invention showing the conductive shield in an unassembled configuration.
Figure 6:
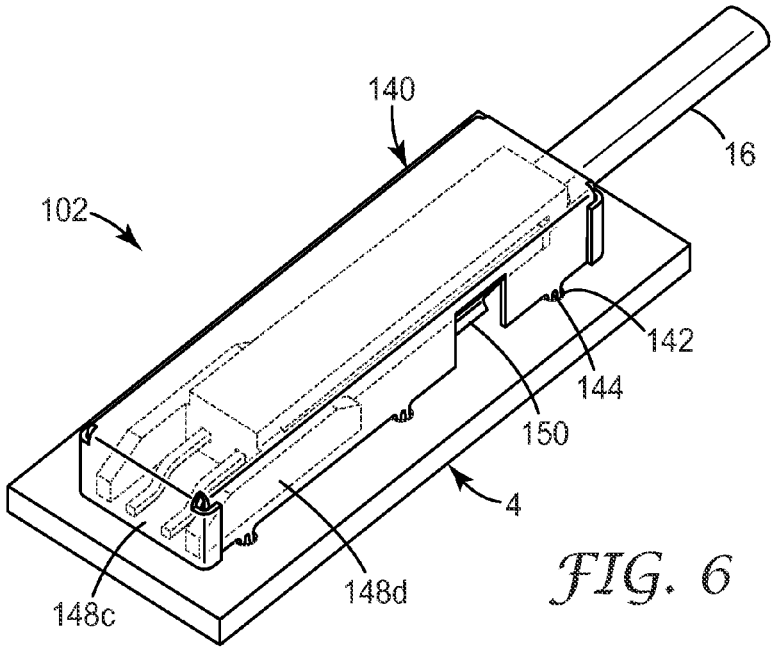
FIG. 6 is a top perspective view of the electrical connector assembly of FIG. 5 showing the conductive shield in an assembled configuration.
Figure 7:
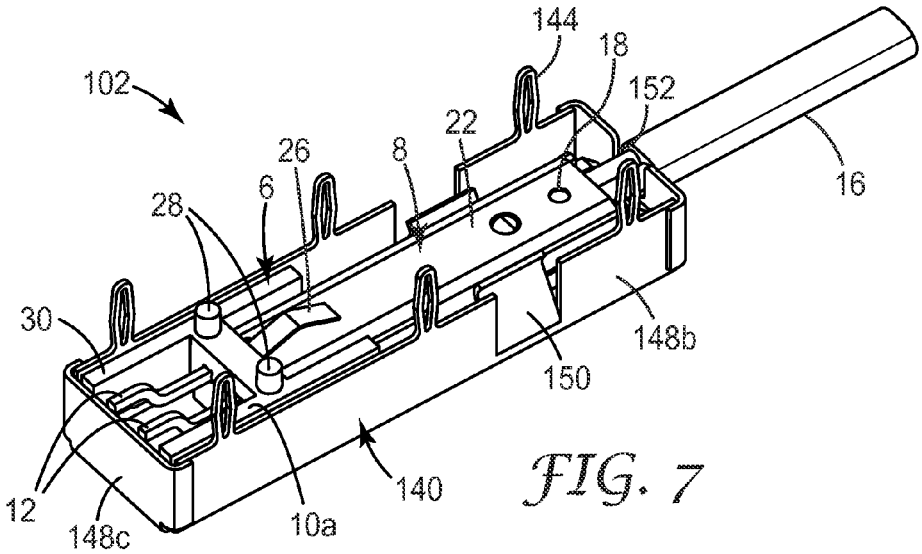
FIG. 7 is a bottom perspective view of the electrical connector assembly of FIG. 5 not showing the printed circuit board.

FIGS. 5-7 illustrate another exemplary embodiment of an electrical connector assembly according to an aspect of the present invention. Electrical connector assembly 102 includes a printed circuit board 4, header 6 coupled to printed circuit board 4, electrical cable termination 8 configured to mate with header 6, and a conductive shield 140 at least partially enclosing header 6 and electrical cable termination 8. Printed circuit board 4, header 6, and electrical cable termination 8 are also illustrated in FIGS. 1-4 and described in detail above. In this exemplary embodiment, printed circuit board 4 additionally includes a plurality of holes 142 configured to receive first conductive shield ground contacts 144 of conductive shield 140. When header 6 and electrical cable termination 8 are in a mated configuration, electrical cable termination 8 makes electrical contact with contact pins 12 and printed circuit board ground contact 14. In alternative embodiments, electrical cable termination 8 may make electrical contact with at least one of contact pins 12 and printed circuit board ground contact 14.

Conductive shield 140 has a top wall 146 and laterally extending side walls 148*a*-148*d* (collectively referred to herein as "side walls 148"). Although the illustrated embodiment includes four side walls 148 defining a substantially rectangular box-shaped conductive shield 140 substantially corresponding with the shape of header 6, conductive shield 140 may have other numbers of side walls defining other shapes as is suitable for the intended application. Although in the illustrated embodiment top wall 146 and side walls 148*b* and 148*d* define a substantially rectangular transverse cross-section, in other embodiments, conductive shield 140 may have a generally curvilinear transverse cross-section. At least one of side walls 148 is configured to enable insertion and extraction of electrical cable termination 8. In the embodiment of FIGS. 5-7, side wall 148*a* extends from top wall 146 such that it can pivot between a closed position (i.e., substantially perpendicular to top wall 146) and an open position (i.e. substantially parallel with top wall 146). In the closed position, side wall 148*a* contributes to shielding of header 6 and electrical cable termination 8 from electromagnetic interference (EMI) emissions. In the open position, side wall 148*a* allows for electrical cable termination 8 to be inserted into or extracted from header 6. Similarly, side wall 148*c* extends from top wall 146 such that it can pivot between a closed position (i.e., substantially perpendicular to top wall 146) and an open position (i.e. substantially parallel with top wall 146). In the closed position, side wall 148*c* contributes to shielding of header 6 and electrical cable termination 8 from electromagnetic interference (EMI) emissions. In the open position, side wall 148*c* allows for access to contact pins 12 of header 6, e.g., for repair or replacement. In part to optimize shielding from electromagnetic interference (EMI) emissions, side walls 148*a* and 148*c* include flanges 154 which overlap a portion of side walls 148*b* and 148*d*. Side wall 148*a* includes an opening 152 configured to provide clearance for electrical cable 16. In one embodiment, opening 152 in side wall 148*a* is shaped such as to allow insertion and extraction of electrical cable termination 8 without the need for side wall 148*a* to pivot.

Figure 7A:
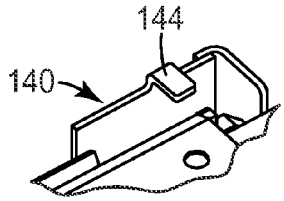
FIG. 7*a* is a bottom perspective view of a portion of the conductive shield of the electrical connector assembly of FIG. 5 showing a first conductive shield ground contact alternatively including a surface mount contact.
Figure 8:
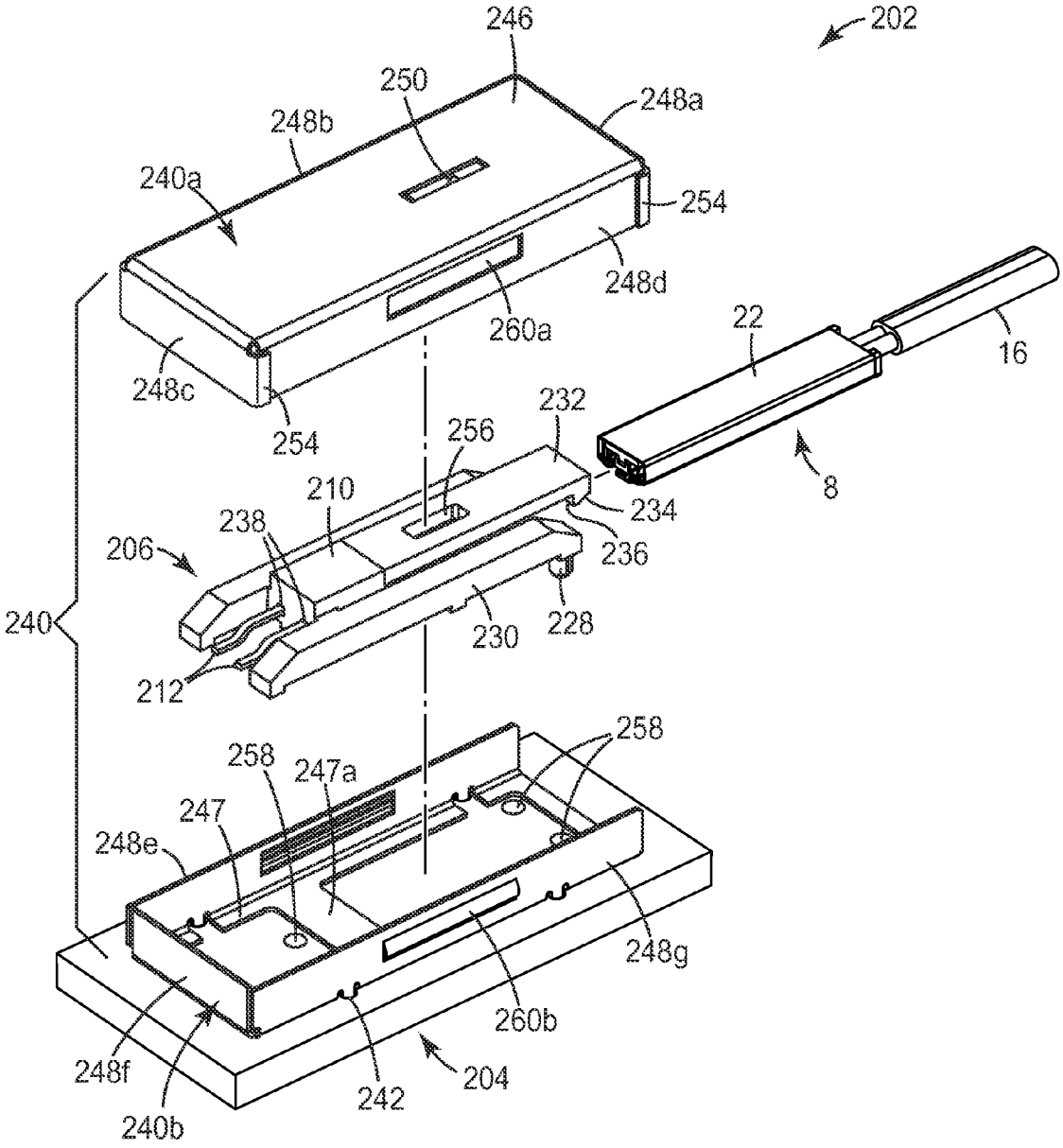
FIG. 8 is a top perspective view of another exemplary embodiment of an electrical connector assembly according to an aspect of the present invention showing the header and conductive shield in an unassembled configuration.
Figure 9:
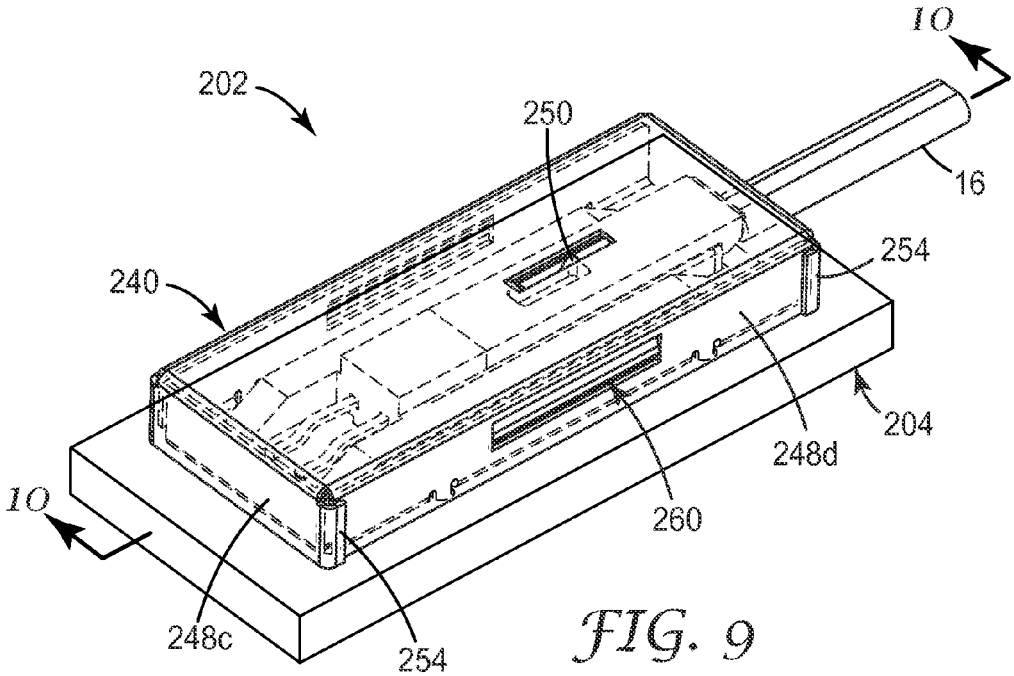
FIG. 9 is a top perspective view of the electrical connector assembly of FIG. 8 showing the header and conductive shield in an assembled configuration.

Conductive shield 140 includes a plurality of first conductive shield ground contacts 144 extending from side walls 148*b* and 148*d*. In other embodiments, one or more first conductive shield ground contacts 144 may extend from one or more side walls 148. First conductive shield ground contacts 144 are configured to couple conductive shield 140 to a printed circuit board ground element (not shown). In the illustrated embodiment, first conductive shield ground contacts 144 are through-hole contacts configured to couple conductive shield 140 to a printed circuit board ground element via holes 142 by soldering, press-fit, or other suitable approach. In another embodiment, first conductive shield ground contacts may be surface mount contacts configured to couple conductive shield 140 to a printed circuit board ground element via, e.g., surface mount pads on printed circuit board 4 by soldering, mechanical clamping, or other suitable approach. FIG. 7*a* illustrates a portion of an exemplary embodiment of a conductive shield 140 wherein first conductive shield ground contacts 144 are surface mount contacts.

Conductive shield 140 further includes inwardly protruding resilient second conductive shield ground contacts 150 disposed on opposed side walls 148*b* and 148*d*. Second conductive shield ground contacts 150 are configured to establish electrical contact between conductive shield 140 and electrical cable termination 8 when header 6 and electrical cable termination 8 are in a mated configuration. In part to optimize shielding from electromagnetic interference (EMI) emissions, second conductive shield ground contacts 150 are sheared from side walls 148*b* and 148*d*, whereby substantially all material of side walls 148*b* and 148*d* remains present. In other embodiments, conductive shield 140 may include only a single second conductive shield ground contact 150. Although the figures show that conductive shield 140 includes inwardly protruding resilient second conductive shield ground contacts 150, it is within the scope of the present invention to use other contact element configurations, such as Hertzian bumps, in place of resilient second conductive shield ground contacts 150.

In one embodiment, conductive shield 140 makes electrical contact with a ground shield of electrical cable 16 when header 6 and electrical cable termination 8 are in a mated configuration. Electrical contact may take place directly, whereby, e.g., side wall 148*a* of conductive shield 140 is in direct contact with the ground shield of electrical cable 16 at opening 152 of side wall 148*a*. Electrical contact may also take place indirectly, whereby, e.g., second conductive shield ground contacts 150 of conductive shield 140 is in direct contact with conductive housing 22 of electrical cable termination 8, which is in direct contact with the ground shield of electrical cable 16 at solder opening 18 of electrical cable termination 8.

In one embodiment, conductive shield 140 includes an electromagnetic interference (EMI) absorbing material (not shown). The EMI absorbing material is typically used for applications requiring electromagnetic absorbing performance. It is designed to suppress radiated noise from electrical devices for broadband radio frequency range. Examples of EMI absorbing materials that can be used in an aspect of the present invention are EMI Absorbers AB-2000 Series or EMI Absorbers AB-5000 Series, both commercially available from 3M Company, St. Paul, Minn. EMI Absorbers AB-2000 Series consist of a thin, flexible backing made of silicone rubber and magnetic materials, with an acrylic pressure-sensitive adhesive. EMI Absorbers AB-5000 Series consists of a flexible soft metal flake filler in polymer resin with an acrylic adhesive system and removable liner. In one aspect, the EMI absorbing material can be adhered to conductive shield 140 after cutting it to a shape that substantially corresponds with at least a portion of the interior surface of conductive shield 140.

In one embodiment, printed circuit board 4 includes a conductive shield element, such as, e.g., conductive shield element 156, shown in FIG. 5, at least partially enclosing header 6 and electrical cable termination 8. Conductive shield element 156 may be formed on printed circuit board 4 by any number of conventional deposition or etching techniques, such as vapor deposition, chemical etching and the like. Alternatively, conductive shield element 156 may be formed as a separate element from metals, conductive polymers, ceramics, or the like. Conductive shield element 156 may comprise, for example, pre-formed pieces of copper, silver, aluminum or other conductor that are positioned on printed circuit board 4 by soldering, press-fit, mechanical clamping, or other suitable approach. Conductive shield element 156 may be formed in any suitable shape, such as, e.g., a shape substantially corresponding with a perimeter defined by side walls 148 of conductive shield 140 as illustrated in FIG. 5. Conductive shield element 156 contributes to shielding of header 6 and electrical cable termination 8 from electromagnetic interference (EMI) emissions. In one embodiment, conductive shield element 156 takes the place of printed circuit board ground contact 14, whereby external electrical cable termination ground contact 26 is configured to make electrical contact with conductive shield element 156 when header 6 and electrical cable termination 8 are in a mated configuration.

In one embodiment, electrical connector assembly 102 includes an electromagnetic interference (EMI) gasket (not shown) positioned around at least a portion of conductive shield 140 and configured to couple conductive shield 140 to a printed circuit board ground element (not shown). The printed circuit board ground element facilitates electrical grounding of electrical connector assembly 102 and can be, e.g., a plurality of ground pads and/or a ground trace. The EMI gasket may be positioned around conductive shield 140 in place of or in addition to the plurality of first conductive shield ground contacts 144 to facilitate substantially uninterrupted shielding around conductive shield 140. To facilitate easy removal of conductive shield 140 from printed circuit board 4, e.g., to provide access to header 6 and/or electrical cable termination 8, the EMI gasket may be positioned around conductive shield 140 in place of the plurality of first conductive shield ground contacts 144. An example of EMI gaskets that can be used in an aspect of the present invention are XYZ-Axis Electrically Conductive Acrylic Pads (eCAP), commercially available from 3M Company, St. Paul, Minn. eCAP products are self-stick EMI gaskets or adhesive transfer tapes which provide good electrical conductive path for EMI shielding and grounding in electronic devices. eCAP achieves a unique filler distribution in three-dimensional structures throughout the adhesive matrix. This filler distribution in a high performance adhesive makes the tape have good xyz-axis electrical conductivity and good adhesion performance. In one embodiment, eCAP is pre-cut into a shape substantially corresponding with a shape defined by the edges of side walls 148 of conductive shield 140. The pre-cut eCAP is then used to adhere conductive shield 140 to printed circuit board 4 (and contact the printed circuit board ground element) to form a substantially uninterrupted shielded interface between conductive shield 140 and printed circuit board 4. Another example of an EMI gasket that can be used in an aspect of the present invention is a gasket fabricated from a rubber elastomer containing conductive particulate material. In one embodiment, the rubber gasket is formed into a rectangular-shaped skirt fitting around conductive shield 140. A groove is formed in the rubber gasket which receives the edges of side walls 148 of conductive shield 140. The rubber gasket is compressible and compressed between conductive shield 140 and printed circuit board 4 (and contacts the printed circuit board ground element) to form a substantially uninterrupted shielded interface between conductive shield 140 and printed circuit board 4.

If conductive shield element 156 is present, the EMI gasket may form a substantially uninterrupted shielded interface between conductive shield 140 and conductive shield element 156.

FIGS. 8-11 illustrate another exemplary embodiment of an electrical connector assembly according to an aspect of the present invention. Electrical connector assembly 202 includes a printed circuit board 204, header 206 coupled to printed circuit board 204, electrical cable termination 8 configured to mate with header 206, and a conductive shield 240 at least partially enclosing header 206 and electrical cable termination 8. Printed circuit board 204 includes a plurality of holes 242 configured to receive first conductive shield ground contacts 244 of conductive shield 240. Electrical cable termination 8 is also illustrated in FIGS. 1-4 and described in detail above. Header 206 includes an insulative housing 210 and a plurality of contact pins 212 disposed in insulative housing 210. When header 206 and electrical cable termination 8 are in a mated configuration, electrical cable termination 8 makes electrical contact with contact pins 212 and conductive shield 240.

Header 206 includes an insulative housing 210 and a plurality of contact pins 212 disposed in insulative housing 210 and arranged for mating with internal contacts 24 of electrical cable termination 8. Contact pins 212 of header 206 are connected to printed circuit board 204 as is known in the art. Contact pins 212 are configured for electrical connection to one or more of a plurality of electrical traces (not shown) of printed circuit board 204. In the embodiment of FIGS. 8-11, header 206 is secured to printed circuit board 204 by the connection between contact pins 212 and printed circuit board 204 as well as mounting posts 228 extending from insulative housing 210. Mounting posts 228 are configured for insertion into holes 258 in printed circuit board 204. Mounting posts 228 may be retained in the holes in printed circuit board 204 by press-fit, adhesive, or other suitable approach.

Insulative housing 210 of header 206 includes two side walls 230, an interior wall 220 positioned between side walls 230, a resilient latch 232 extending from interior wall 220, and mounting posts 228 extending from a bottom surface 210*a* of insulative housing 210. Insulative housing 210 is monolithic. Insulative housing 210 is configured to receive and position electrical cable termination 8, which is retained in a mated configuration by latch 232. As electrical cable termination 8 is inserted into header 206, a front edge 8*b* of electrical cable termination 8 engages a latch lead-in surface 234 and deflects latch 232 out of the path of electrical cable termination 8. As electrical cable termination 8 is fully inserted, latch 232 returns to its original (undeflected) position, and a latch hook member 236 engages a back edge 8*c* of electrical cable termination 8, thereby preventing electrical cable termination from being pulled out of header 206. Electrical cable termination 8 can be removed from header 206 by simply deflecting latch 232 (as with a small tool or fingernail) to disengage latch hook member 236 from back edge 8*c* of electrical cable termination 8 while pulling gently on electrical cable 16. Latch 232 further includes a latch opening 256 configured to enable second conductive shield ground contact 250 (described below) to establish electrical contact between conductive shield 240 and electrical cable termination 8 when header 206 and electrical cable termination 8 are in a mated configuration. Interior wall 220 of insulative housing 210 includes a plurality of pin insertion apertures 238 configured to position and retain contact pins 212. Contact pins 212 may be retained in insertion apertures 238 by press-fit, friction fit, adhesive, or other suitable approach. Side walls 230 are configured to assist in aligning internal contacts 224 of electrical cable termination 8 and contact pins 212 during insertion of electrical cable termination 8 into header 206. Additionally, side walls 230 assist in providing stability to header 206 and protect contact pins 212 from being damaged.

Still referring to FIGS. 8-11, conductive shield 240 is a two-part shield and includes a top shield portion 240*a* and a bottom shield portion 240*b*. Top shield portion 240*a* has a top wall 246 and laterally extending top shield side walls 248*a*-248*d*. Bottom shield portion 240*b* has a bottom wall 247 and laterally extending bottom shield side walls 248*e*-248*g*. Top shield side walls 248*a*-248*d* and bottom shield side walls 248*e*-248*g* are collectively referred to herein as "side walls 248". Although the illustrated embodiment includes seven side walls 248 defining a substantially rectangular box-shaped conductive shield 240 substantially corresponding with the shape of header 206, conductive shield 240 may have other numbers of side walls defining other shapes as is suitable for the intended application. Although in the illustrated embodiment top wall 246, bottom wall 247 and side walls 248*b*/248*e* and 248*d*/248*g* define a substantially rectangular transverse cross-section, in other embodiments, conductive shield 240 may have a generally curvilinear transverse cross-section. In the embodiment of FIGS. 8-11, top shield side walls 248*b*-248*d* extend from top wall 246 such that they overlap with bottom shield side walls 248*e*-248*g* when top shield portion 240*a* and bottom shield portion 240*b* are in an assembled configuration. When top shield portion 240*a* and bottom shield portion 240*b* are in an assembled configuration, top shield portion 240*a* contributes to shielding of header 206 and electrical cable termination 8 from electromagnetic interference (EMI) emissions. When top shield portion 240*a* and bottom shield portion 240*b* are in unassembled configuration, electrical cable termination 8 can be inserted into or extracted from header 206 and contact pins 212 of header 206 can be accessed, e.g., for repair or replacement. In part to optimize shielding from electromagnetic interference (EMI) emissions, top shield side walls 248*a* and 248*c* include flanges 254 which overlap a portion of top shield side walls 248*b* and 248*d*. Top shield side wall 248*a* includes an opening 252 configured to provide clearance for electrical cable 16. In one embodiment, top shield 240*a* and bottom shield 240*b* include cooperative locking elements 260 configured to retain top shield 240*a* and bottom shield 240*b* in an assembled configuration. In the embodiment of FIGS. 8-11, top shield 240*a* includes locking apertures 260*a* on opposing top shield side walls 248*b* and 248*d* that engage corresponding locking strips 260*b* on opposing bottom shield side walls 248*e* and 248*g*. In other embodiments, top shield 240*a* and bottom shield 240*b* may be retained in an assembled configuration by any suitable method/structure, including but not limited to snap fit, friction fit, press fit, mechanical clamping, and adhesive.

Conductive shield 240 includes a plurality of first conductive shield ground contacts 244 extending from bottom shield side walls 248*e* and 248*g*. In other embodiments, one or more first conductive shield ground contacts 244 may extend from one or more side walls 248. First conductive shield ground contacts 244 are configured to couple conductive shield 240 to a printed circuit board ground element (not shown). In the illustrated embodiment, first conductive shield ground contacts 244 are through-hole contacts configured to couple conductive shield 240 to a printed circuit board ground element via holes 242 by soldering, press-fit, or other suitable approach.

Conductive shield 240 further includes an inwardly protruding resilient second conductive shield ground contact 250 disposed on top wall 246. Second conductive shield ground contact 250 is configured to establish electrical contact between conductive shield 240 and electrical cable termination 8 when header 206 and electrical cable termination 8 are in a mated configuration. In part to optimize shielding from electromagnetic interference (EMI) emissions, second conductive shield ground contact 250 is sheared from top wall 246, whereby substantially all material of top wall 246 remains present. In other embodiments, conductive shield 240 may include more than one second conductive shield ground contact 250.

Figure 11:
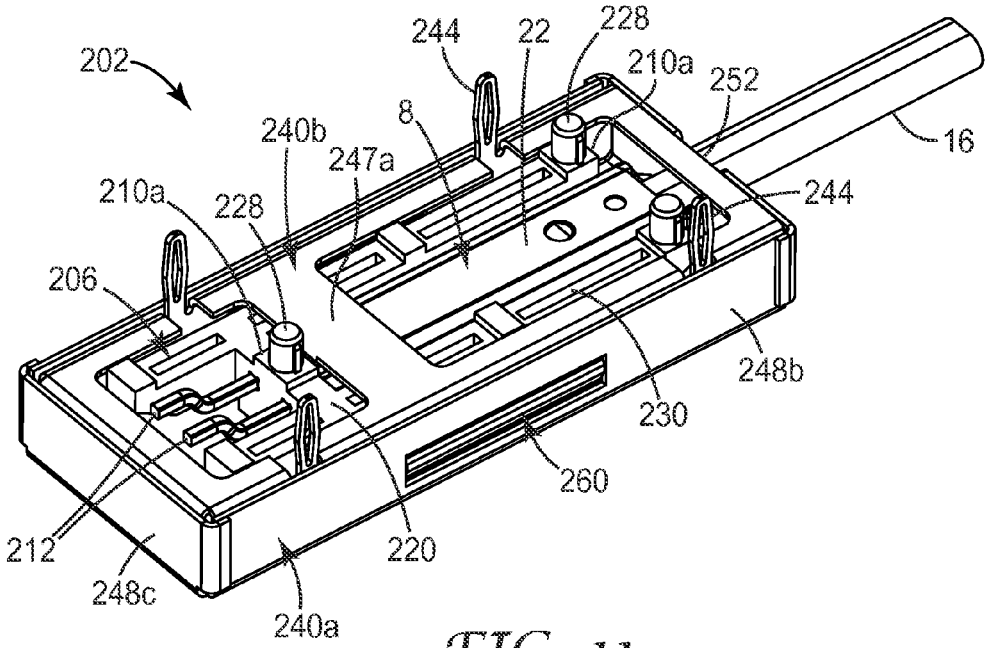
FIG. 11 is a bottom perspective view of the electrical connector assembly of FIG. 8 not showing the printed circuit board.
Figure 10:
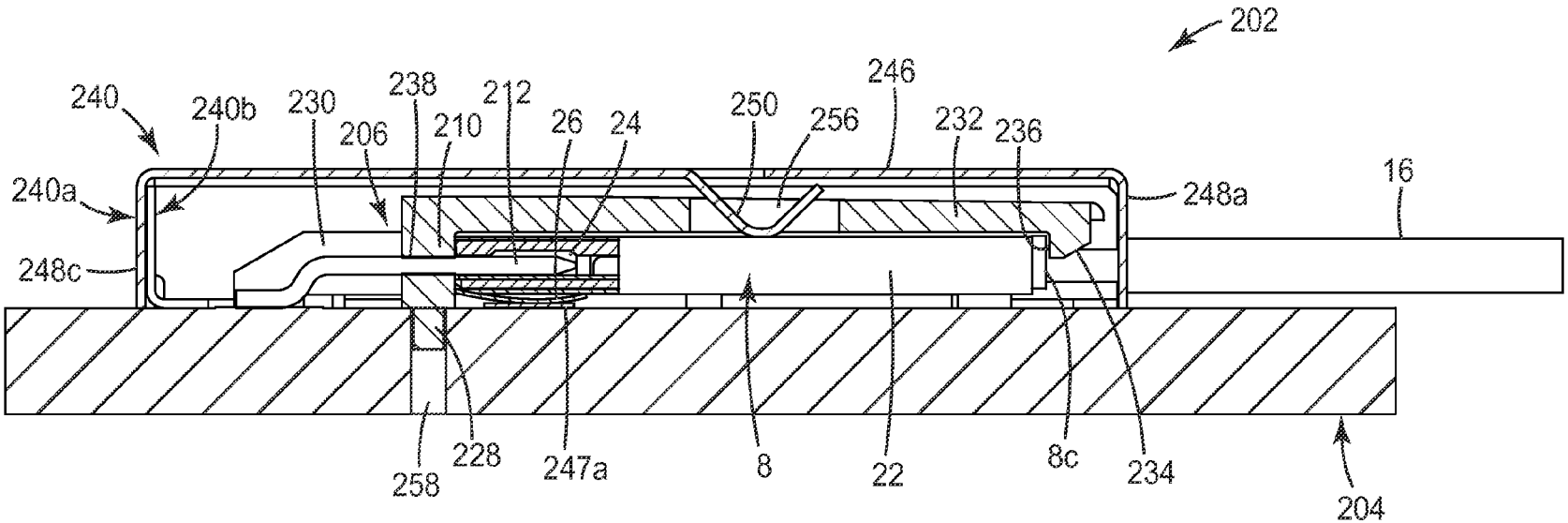
FIG. 10 is a cross-sectional view of the electrical connector assembly of FIG. 8 taken along line 10-10 of FIG. 9.

In the embodiment illustrated in FIGS. 8-11, bottom wall 247 includes an optional bridge portion 247*a*. Bridge portion 247*a* is configured to make electrical contact with external electrical cable termination ground contact 26 of electrical cable termination 8 when header 206 and electrical cable termination 8 are in a mated configuration, as best shown in FIG. 11. In the absence of bridge portion 247*a*, external electrical cable termination ground contact 26 may be configured to make electrical contact with a ground contact, such as, e.g., ground contact 14 of printed circuit board 4.

In each of the embodiments and implementations described herein, the various components of the electrical connector assembly and elements thereof are formed of any suitable material. The materials are selected depending upon the intended application and may include both metals and non-metals (e.g., any one or combination of non-conductive materials including but not limited to polymers, glass, and ceramics). In one embodiment, the electrically insulative components, such as, e.g., insulative housing 10, are formed of a polymeric material by methods such as injection molding, extrusion, casting, machining, and the like, while the electrically conductive components, such as, e.g., electrically conductive housing 22, internal contacts 24, conductive shield 140, and contact pins 12, are formed of metal by methods such as molding, casting, stamping, machining, and the like. Material selection will depend upon factors including, but not limited to, chemical exposure conditions, environmental exposure conditions including temperature and humidity conditions, flame-retardancy requirements, material strength, and rigidity, to name a few.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the mechanical, electromechanical, and electrical arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. An electrical connector assembly comprising:

a printed circuit board having a printed circuit board ground contact pad;

a header coupled to the printed circuit board and comprising an insulative housing having opposing side walls, an interior wall positioned between the side walls, and a resilient latch extending from the interior wall, and a plurality of contact pins disposed in the insulative housing; and an electrical cable termination configured to mate with the header and comprising an internal contact within an electrically conductive tubular housing and an external electrical cable termination ground contact extending from an external surface of the housing, wherein the header and electrical cable termination are configured such that the internal contact makes direct separable electrical contact with one of the plurality of contact pins, and the external electrical cable termination ground contact makes direct separable electrical contact with the printed circuit board ground contact pad when the header and electrical cable termination are in a mated configuration.

2. The electrical connector assembly of claim 1, wherein the electrical cable termination is retained by the header using one of a snap fit, friction fit, press fit, mechanical clamping, and adhesive.

3. The electrical connector assembly of claim 1, wherein the electrical cable termination is one of a coaxial cable termination and a twinaxial cable termination.

4. The electrical connector assembly of claim 1, wherein the latch is configured to retain the electrical cable termination in a mated configuration.

5. The electrical connector assembly of claim 1, wherein the header comprises one of a surface mount header and a through-hole header.

6. An electrical connector assembly comprising:

a printed circuit board having a printed circuit board ground contact pad;

a header coupled to the printed circuit board and comprising an insulative housing having opposing side walls, an interior wall positioned between the side walls, and a resilient latch extending from the interior wall, and a plurality of contact pins disposed in the insulative housing;

an electrical cable termination configured to mate with the header and comprising an internal contact within an electrically conductive tubular housing and an external electrical cable termination ground contact extending from an external surface of the housing; and a conductive shield at least partially enclosing the header and electrical cable termination, wherein the header and electrical cable termination are configured such that the internal contact makes direct separable electrical contact with one of the plurality of contact pins, and the external electrical cable termination ground contact makes direct separable electrical contact with the printed circuit board ground contact pad when the header and electrical cable termination are in a mated configuration.

7. The electrical connector assembly of claim 6, wherein the conductive shield comprises one or more second conductive shield ground contacts configured to establish electrical contact between the conductive shield and the electrical cable termination when the header and electrical cable termination are in a mated configuration.

8. The electrical connector assembly of claim 6, wherein the conductive shield comprises an electromagnetic interference (EMI) absorbing material.

9. The electrical connector assembly of claim 6, wherein the conductive shield comprises a top wall and laterally extending side walls, and wherein at least one of the side walls is configured to enable insertion and extraction of the electrical cable termination.

10. The electrical connector assembly of claim 6, wherein the printed circuit board further comprises a planar conductive shield element at least partially enclosing the header and electrical cable termination.

11. The electrical connector assembly of claim 6, wherein the electrical cable termination is coupled to an electrical cable including one or more conductors and a ground shield surrounding the one or more conductors.

12. The electrical connector assembly of claim 11, wherein the conductive shield makes electrical contact with the ground shield when the header and electrical cable termination are in a mated configuration.

13. The electrical connector assembly of claim 6 further comprising an electromagnetic interference (EMI) gasket positioned around at least a portion of the conductive shield configured to couple the conductive shield to a printed circuit board ground element.

14. The electrical connector assembly of claim 13, wherein the printed circuit board ground element comprises one or more of a plurality of ground pads and a ground trace.

15. The electrical connector assembly of claim 6, wherein the conductive shield comprises one or more first conductive shield ground contacts configured to couple the conductive shield to a printed circuit board ground element.

16. The electrical connector assembly of claim 15, wherein the one or more first conductive shield ground contacts comprise one of a through-hole contact and a surface mount contact.

17. The electrical connector assembly of claim 15, wherein the conductive shield comprises a top wall and laterally extending side walls, and wherein the one or more first conductive shield ground contacts extend from at least one of the side walls.

18. An electrical connector assembly comprising:

a printed circuit board having a printed circuit board ground contact pad and a printed circuit board ground element;

a header coupled to the printed circuit board and comprising an insulative housing having opposing side walls, an interior wall positioned between the side walls, and a resilient latch extending from the interior wall, and a plurality of contact pins disposed in the insulative housing;

an electrical cable assembly configured to mate with the header and comprising an electrical cable termination and an electrical cable including one or more conductors and a ground shield surrounding the one or more conductors, the electrical cable termination comprising an internal contact within an electrically conductive tubular housing and an external electrical cable termination ground contact extending from an external surface of the housing; and a conductive shield coupled to the printed circuit board ground element and at least partially enclosing the header and electrical cable assembly, wherein the header, electrical cable assembly, and conductive shield are configured such that the internal contact makes direct separable electrical contact with one of the plurality of contact pins, the external electrical cable termination ground contact makes direct separable electrical contact with the printed circuit board ground contact pad, and the conductive shield makes electrical contact with at least one of the electrical cable termination and the ground shield when the header and electrical cable assembly are in a mated configuration.

19. The electrical connector assembly of claim 18, wherein the printed circuit board further comprises a planar conductive shield element at least partially enclosing the header and electrical cable assembly.

* * * * *

UNITED STATES PATENT AND TRADEMARK OFFICE

CERTIFICATE OF CORRECTION

PATENT NO. : 7,892,007 B2
APPLICATION NO. : 12/192265
DATED : February 22, 2011
INVENTOR(S) : Richard J Scherer It is certified that error appears in the above-identified patent and that said Letters Patent is hereby corrected as shown below:

Column 10,
Lines 65-66, delete "electromechanical," and insert --electro-mechanical,-- therefor.

Signed and Sealed this
Second Day of August, 2011

David J. Kappos

David J. Kappos
*Director of the United States Patent and Trademark Office*